United States Patent [19]

Zurcher

[11] 4,028,509

[45] June 7, 1977

[54] SIMPLIFIED TABULATOR KEYBOARD ASSEMBLY FOR USE IN WATCH/CALCULATOR HAVING TRANSPARENT FOLDABLE FLEXIBLE PRINTED CIRCUIT BOARD WITH CONTACTS AND ACTUATOR INDICIA

[75] Inventor: Rudolf F. Zurcher, Newport Beach, Calif.

[73] Assignee: Hughes Aircraft Company, Culver City, Calif.

[22] Filed: Aug. 29, 1975

[21] Appl. No.: 608,852

[52] U.S. Cl. ..... 200/5 A; 58/50 R; 58/152 R; 174/68.5; 200/86 R; 200/159 B; 200/292; 361/398

[51] Int. Cl.² ..... G04B 47/06; G04B 19/30; H01H 9/00; H01H 13/02

[58] Field of Search ..... 200/1 R, 5 R, 54, 16 A, 200/86 R, 159 B, 292, 340, 314, 317, 153 M, 308; 58/50 R, 152 R; 235/156; 317/101 F

[56] References Cited

UNITED STATES PATENTS

| | | | |
|---|---|---|---|
| 3,383,487 | 5/1968 | Wiener | 200/292 X |
| 3,440,429 | 4/1969 | Murphy et al. | 200/314 X |
| 3,742,157 | 6/1973 | Leposavic | 200/159 B X |
| 3,745,288 | 7/1973 | Reimer | 200/292 |
| 3,777,222 | 12/1973 | Harris | 200/5 R X |
| 3,803,834 | 4/1974 | Reese | 58/152 R |
| 3,829,632 | 8/1974 | Klehm, Jr. | 200/159 B X |
| 3,831,063 | 8/1974 | Keough | 200/159 B X |
| 3,843,851 | 10/1974 | Harada et al. | 200/340 X |
| 3,860,771 | 1/1975 | Lynn et al. | 200/159 B X |
| 3,909,564 | 9/1974 | Scheingold et al. | 200/5 A X |
| 3,911,234 | 10/1975 | Kotaka | 200/5 A |
| 3,928,960 | 12/1975 | Reese | 58/152 R |

OTHER PUBLICATIONS

IBM Technical Disclosure Bulletin, J. R. Lester, et al., "Switch," Apr. 1969, vol. 11, No. 11, p. 1569.

IBM Technical Disclosure Bulletin, C. P. Ludeman and D. H. Strait, Wrist-Worn Terminal, vol. 15, No. 11, Apr. 1973, pp. 3350, 3351.

*Primary Examiner*—James R. Scott

*Attorney, Agent, or Firm*—Fay I. Konzem; W. H. MacAllister

[57] ABSTRACT

A tabulator keyboard of simplified design may be fabricated from a single flexible circuit and a minimum of other mechanical structures. The flexible circuit combines in one piece an array of deformable upper contacts, an array of stationary lower contacts, as well as the required interconnections between the elements of these arrays and the electronics module. The flexible circuit may be made of a reasonable transparent dielectric film (e.g. polyamide). The flexible circuit is folded in use such that the lower stationary array has its conductive surface opposite the upper deformable array. Means are provided for making electrical contact between a selected element in said lower array with a selected element in said upper array.

4 Claims, 5 Drawing Figures

SIMPLIFIED TABULATOR KEYBOARD ASSEMBLY FOR USE IN WATCH/CALCULATOR HAVING TRANSPARENT FOLDABLE FLEXIBLE PRINTED CIRCUIT BOARD WITH CONTACTS AND ACTUATOR INDICIA

FIELD OF THE INVENTION

This invention pertains generally to tabular keyboard usable for providing control of electronics modules and in particular to miniaturized keyboards particularly suitable for use with an electronic wristwatch calculator combination.

PRIOR ART

Prior miniature keyboards for use with electronic modules have been of relatively complex constructions typically including a semi-rigid plastic top window plate, a tough film of plastic with printed digits and signs, a grounded metallized elastomeric sheet, a perforated insulating spacer and a rigid printed circuit board provided with feedthrough holes and wiring pins associated with a two dimensional array of electrodes. Such a structure is relatively bulky and in the case of a practical wristwatch/calculator case, requires a minimum of 20% of the whole space available within such a case. Typically, dimensions for such a prior art unit might be 1 inch (2.540 cm) by 1 inch (2.540 cm) by ½ inch (1.270 cm ) high.

Accordingly, one object of the present invention is to provide a tabulator keyboard assembly making maximum utilization of available space.

A second object of the present invention is to provide a calculator tabulator keyboard structure featuring integral wiring including optional connection between an electronics module and a display module.

A third ojbect of the present invention is to provide a tabulator keyboard structure which is easily manufactured and of uniform quality in production.

A fourth object of the present invention is to provide a tabulator keyboard assembly which utilizes a single folded flexible circuit to replace a plurality of discrete conductive and insulative elements.

SUMMARY OF THE INVENTION

Briefly, the above and other objects may be satisfied in accordance with the present invention by means of a simplified tabulator keyboard design fabricated from a single flexible circuit and a minimum of other mechanical structures. The flexible circuit combines in one piece an array of performable upper contacts, and array of satationary lower contacts, as well as the required interconnections between the elements of these arrays and the electronics module. The flexible circuit is folded in use such that the lower stationary array has its conductive surface suits opposite those of the upper deformable array. Means are provided for making electrical contact between a selected element in said lower array of the selected element in said upper array. Optionally indicia of digits and/or keyboard functions may be incorporated as part of the flexible circuit and also folded such at the particular indicium associated with the connection of a particular element in said lower array and a particular element in said upper array is visible at the location of the intersection of said two particular elements.

BRIEF DESCRIPTION OF THE DRAWING

For a better understanding of the present invention and one preferred embodiment thereof, reference is made to the following detailed description and the accompanying drawngs in which.

DETAILED DESCRIPTION OF A PREFERRED EMBODIMENT

Figure 1:
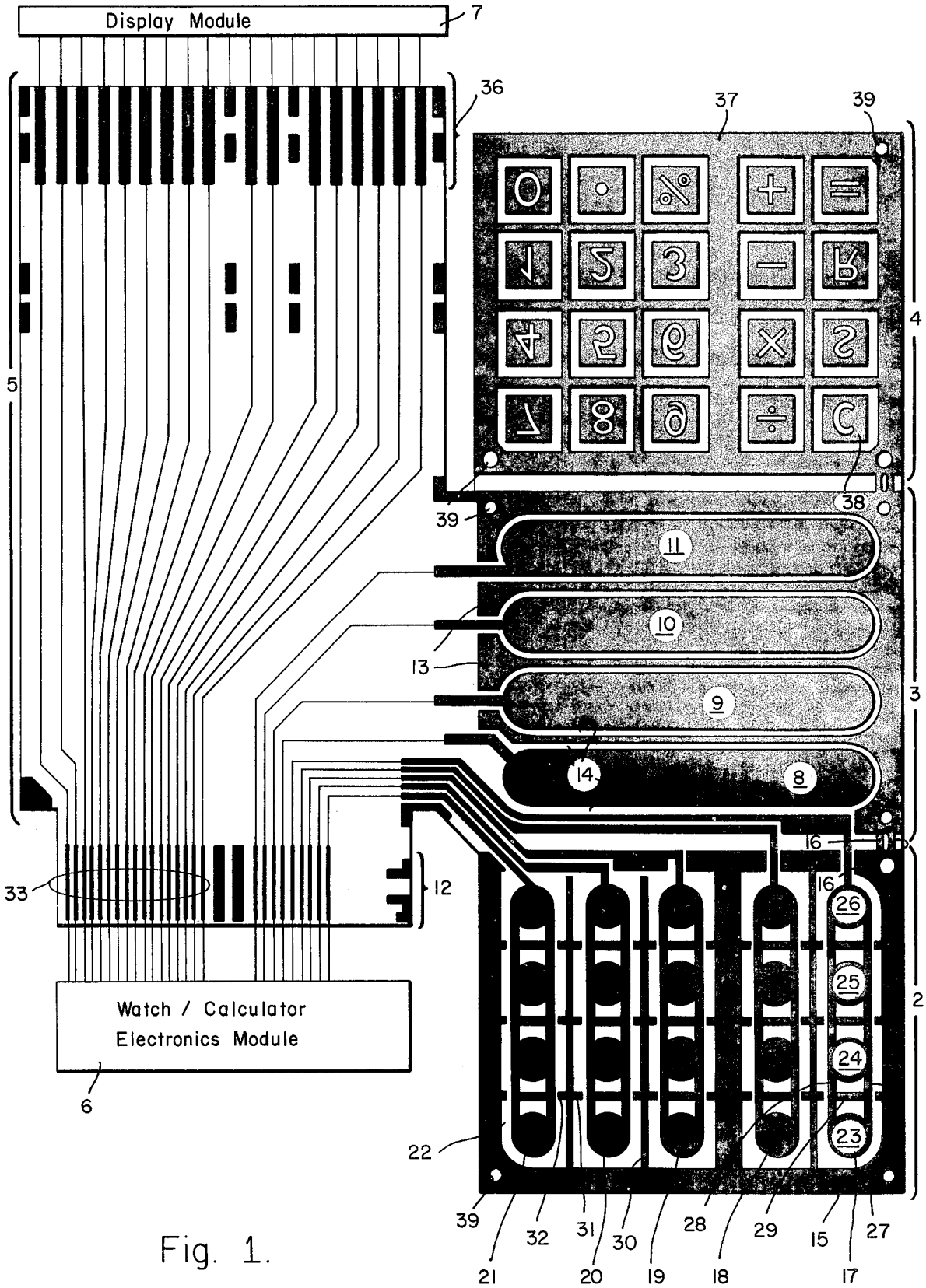
FIG. 1 is a layout drawing of a flexible circuit utilized in the preferred embodiment of the present invention in its unfolded state together with an indication of how connection is made to other modules.

Referring now with particularity to FIG. 1, it may be seen that there is provided a single flexible circuit indicated generally by the reference numeral 1, comprising an upper deformable array of contact elements 2, a lower stationary array of contact elements 3, an array of numerical and other indicia 4, and a plurality of electrical interconnections 5. The flexible circuit may be manufactured using processes well known in the flexible conductor art and may, for example, be formed of electroformed copper on one side of a reasonable transparent dielectric film formed out of polyamide or other suitable material of approximately 3 mils thickness resulting in a total thickness of from between 4½ to 6 mils. Preferably, the copper conductive areas are finished with a 30 microinch layer of gold to protect them from corrosion and other deterioration and to lower the resistance at the point of contact when the device is in use. As will become more clear hereinafter, the deformable array 2 is folded over the fixed array 3, such that electrical connection may be made between a particular element of said deformable array and a particular element of said stationary array. Indicated in the figure in block diagram form is a watch/calculator electronics module 6, the precise details of which are not the subject of the present invention but which may be of the type disclosed in a copending application Ser. No. 653,189 entitled "Digital wristwatch/Calculator" of inventors R. S. Belardi, Epperson I. B. Merles and N.F. Moyer, filed on even date Jan. 28, 1976 and assigned to the same assignee of the present invention and which is incorporated by reference herein the same as though fully set out. Also indicated as a block in FIG. 1, is a display module 7 which may be of any number of types well known in the watch/calculator art, including light emitting diodes (LED's) or liquid crystal displays (LCD's) or a combination thereof. Not indicated in FIG. 1 is a power source of a type also well known in the art, which is obviously required for the proper operation of the electronics and display modules.

Referring now with greater particularity to the lower stationary array 3, it may be seen that this array comprises four horizontal contact portions (indicated respectively by reference numerals 8, 9, 10 and 11) each of about 0.130 inch (0.3302 cm) in width and leading by a respective appropriately located metallic interconnection of width preferably equal to or greater than 0.010 inch (0.0254 cm) provided on the upper surface of flexible cable 1 to a first array 12 of electrical contacts provided as part of interconnection array portion 5. Lower stationary array portion 3 is also provided with a (possibly grounded) metallic reinforcing member 13 of the same material as the conductive portions of the flexible circuit 1 which provides additional mechanical and structural ridigity to lower porton 3 and which is separated from the various contacts 8, 9, 10 and 11 by means of an insulating area 14 of about 0.010 inch (0.0254 cm) in width.

Referring now with particularity to upper deformable contact array portion 2 of the flexible circuit, it may be seen that it is also provided with a conductive reinforcing portion 15 which in the embodiment shown is electrically connected to the corresponding portion 13 of the lower array by means of bridge elements 15 and 16. However, it is separated from the corresponding horizontal array of vertical deformable contacts 17, 18, 19, 20 and 21 by means of a relatively wide (typically about 0.30 in. or 0.0762 cm.) insulating region 22, thereby providing for additional flexibility between said deformable array and the rest of the upper array portin 2. Referring now to an individual member of said horizontal array, for example, the rightmost one indicated by the reference numeral 17, it may be seen that this comprises four conductive pad (typical diameter 0.100 in. or 0.254 cm.) areas 23, 24, 25 and 26, all connected to one another by means of relatively flexible (typical width 0.010 in. or 0.0254 cm.) conductive bridges 27 and 28. Additionally, there is provided a bridge reinforcing area (one of which is indicated by the reference numeral 29) which has the desirable effect of reducing the influence of the deformation of, for instance, conductive pads 23 from spreading to the general area of conductive pad of the adjacent conductive pad 24. It may be seen also that adjacent ones of said deformable contacts of said horizontal array are separated by vertical reinforcing portions of width preferably at least 0.010 in. or 0.0254 cm. such as that indicated by the reference numeral 30 which also includes additional mechanical reinforcing tabs such as indicated by the reference numeral 31 and 32, in alignment with and corresponding to the reinforcing portions with the bridge reinforcing portions 29, etc. Each one of the deformable contacts located in portion 2 also has a conductive path leading to its respective contact on other upper contact portions 12.

Contact termination portion 12 of interconnection 5 is also provided with a plurality of contact terminations 33 which make electrical contact to respective contact terminations to individual contacts located in a second contact termination region 36 on the opposite extremity of interconnection portion 5. As is clearly shown in the figure, the contacts in the first contact termination portion 12 may be used to connect the various contacts in upper and lower arrays 2 and 3 with the relevant inputs to electronics module 6 and may be also used to connect the outputs of said module via contact terminations 33 to display module 7 via said second contact termination region 36. Although not indicated clearly in this or any of the subsequent figures, it should be noted that the whole of the interconnection portion 5 may be of any size or shape and may be folded as required to fit the needs of the particular layout of power, electronics and display modules within the case of the watch/calculator, much as any other flexible circuit may be employed to effect the revelent connections between various electronics and other modules.

Finally, it may be seen that indicia portion 4 of flexible circuit 5 also has a background reinforcing region 37 provided for the plurality of square windows with square indicia inserts, one of which is indicated by the reference numeral 38, formed of the same electrically conductive material as the other conductive portions of the flexible circuit. It is to be noted that the various indicia are reversed left to right as shown in the layout of FIG. 1 from their normal orientation as seen by the observer, inasmuch as indicia portion 4 will in use be folded over (in the manner illustrated in greater detail in FIG. 2). Referring to the indicium "C" indicated by the reference numeral 38, it may be seen that this particular indicia will in use be located directly above tab portion 23 and horizontal conductor 11. The various other indicia re also located so that they are above (after the flexible circuit has been appropriately folded) the intersection of the relevant tab portion with the relevant horizontal conductor. A plurality of rivet and locating holes 39 are also provided for facilitating the assembly process.

It might be noted that although a 20 element keyboard is illustrated (including the numbers "0" through "9" as well as ".", "%", "+", "=", "–", "x", "÷", "R", "S", and "C") the invention is by no means limited to this particular choice of symbols and larger or smaller arrays are also possible without departing from spirit of the invention.

Figure 2:
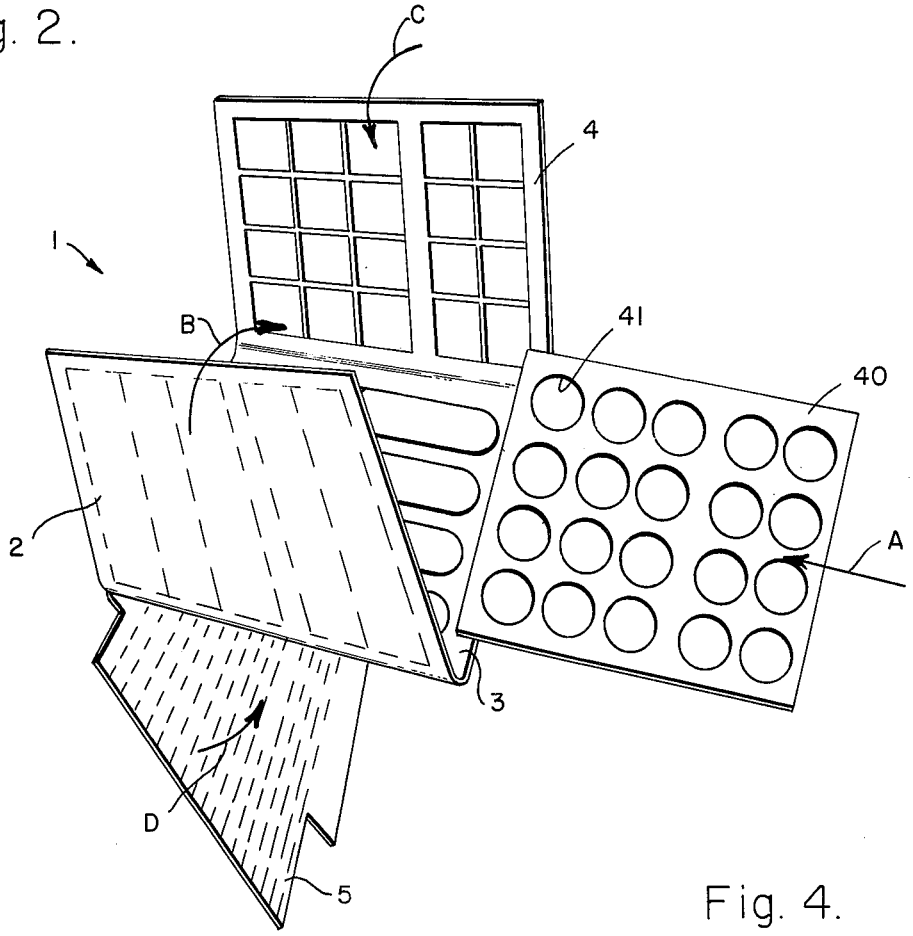
FIG. 2 is a perspective drawing showing how the circuit of FIG. 1 may be folded around a perforated insulating spacer prior to assembly within a watch or other small case.

Referring now with greater particularity to FIG. 2, it may be seen that in the course of assembly the printed circuit 1 has a perforated spacer 40 preferably of mylar or some other insulative plastic and of thickness at least 2 mils inserted over lower stationary portion 3 as indicated by the arrow A. Perforated spacer 40 may be an integral part of the flex circuit itself; in which case spacer would be folded over portion 3. Said spacer is provided with a plurality of holes 41 provided which, as will become more clear hereinafter, are located directly between the various tabs portions 23 of deformable array portion 2 and the conductive strip portions of stationary contact array 3. Next, as indicated by the arrow B, deformable upper contact portion 2 is folded over said lower array and said spacer, whereupon indicia portion 4 as indicated by arrow C, may then be folded over said deformable upper portion 2 resulting (as will become more clear hereinafter with reference to FIGS. 3 and 4) in a sandwich having as its first layer indicia portion 4, as its second layer upper deformable contact array portion 2, as its third layer perforated spacer 40, and as its bottom layer lower stationary contact portion 3. Finally, preferably after said package has been completed by the addition of a rigid window plate and a backplate, the whole package being fastened together by rivets passing through the aforementioned locating holes 39, flexible conductor portion 5 may then be folded over or around in such a manner as is required for the particular application or may be left extending out from the side of the sandwich.

Figure 3:
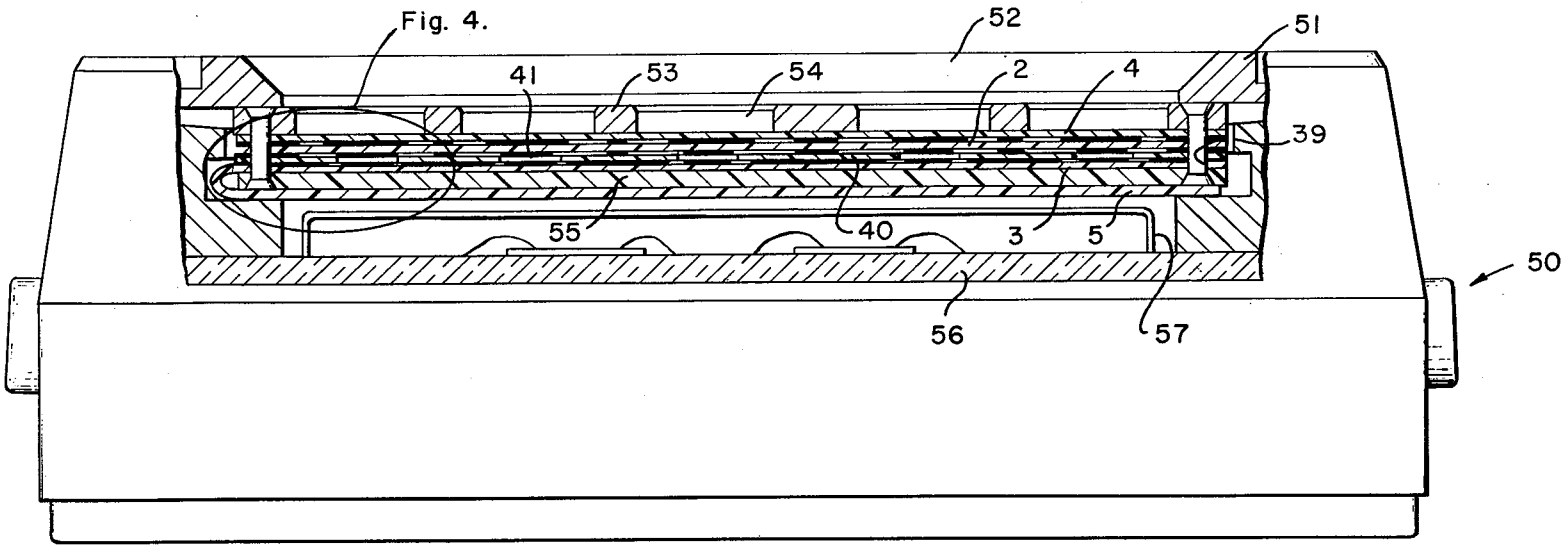
FIG. 3 is a side elevation partly in cross section of an electronic wristwatch/calculator case showing the tabulator keyboard of the present invention installed therein.

Referring now with particularity to FIG. 3 where the completed sandwich is shown installed in a watchase 50 having on the upper surface 51 thereof an aperture 52 through which is accessible, by means of a ballpoint pen, pencil, stylus or other blunt instrument, a rigid window plate 53 having a plurality of windows 54 for the application of pressure by means of such an instrument to the intersection of one of the deformable contacts in said upper array with one of the stationary contacts in said lower array, said pressure being transmitted through the particular indicium associated therewith, below said window plate are the several layers 4 to 63 of said sandwich and a backing plate 55 formed of a fairly thin rigid insulative material, as well as the dependent flexible conductor portion 5. Not visible in the particular cross section of this figure are the electrical connections being made between connector termination portions 12 and 36 with the electronic and other modules attached to a substrate 56 and perferably shielded by means of a metallic shield 57.

Figure 4:
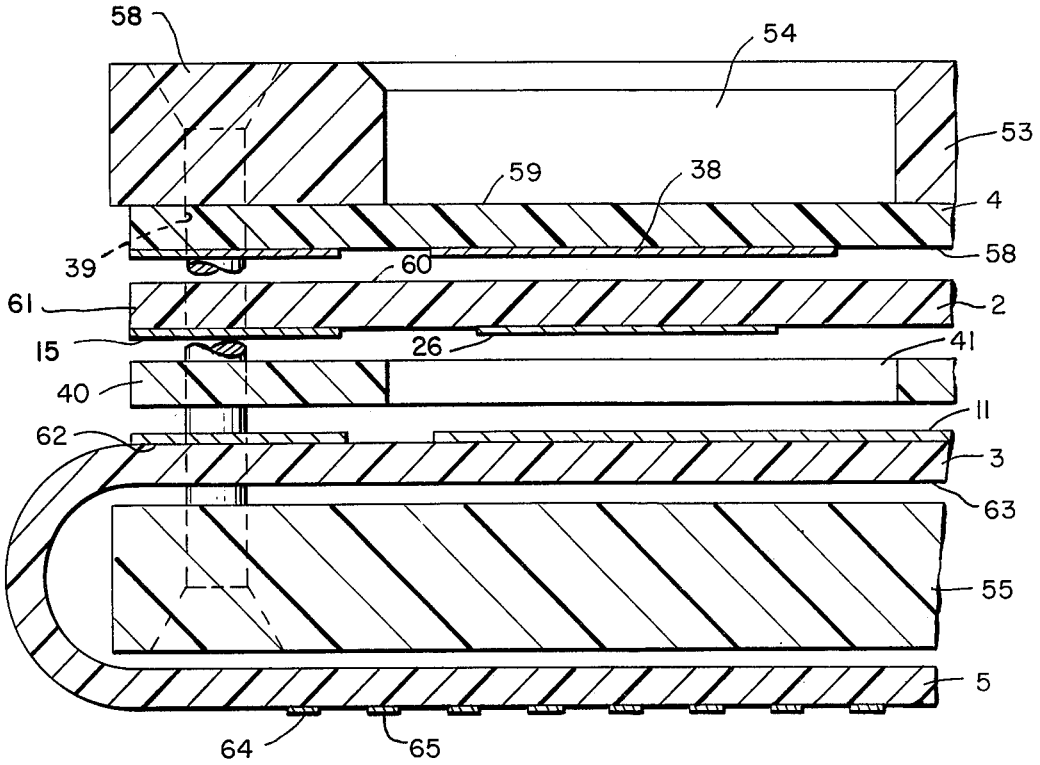
FIG. 4 is an enlargement of a portion of FIG. 3 showing more clearly how the various folded layers of the flexible circuit of FIG. 1 make the required electrical connections and how the flexible circuit is located with respect to certain other mechanical components.

Referring now specifically to FIG. 4 which shows a portion of the aforementioned FIG. 3 in greater detail, including the various parts of the sandwich directly beneath one of said windows 54, it may be seen that the whole of the sandwich is fixed by a plurality of rivets 58 located in the rivet holes 19 provided as aforesaid as part of said flexible circuits. On the lower surface 58 of said indicia portion 4 there is visible in cross section a portion of one of said indicia 38, the upper surface 59 thereof being exposed to one of windows 54, but not having any metallic area thereon. The metallization forming the indicia is thereby protected from abrasion caused by the use of a stylus or other blunt instrument in the operation of the device. Below indicium 38 is located the upper surface 60 of upper deformable contact portion 2, on the lower surface 61 of which is to be found a particular one of the aforesaid conductive tabs (for example 26). Directly below tab 26 is a given one of said circular holes 41 provided in the perforated insulated spacer 40. Below and exposed to said hole is to be seen the metallization forming a particular one (for example 11) of the array of stationary contacts located on the upper surface 62 of said lower stationary contact array portion 3. The lower surface 63 of said lower array portion lies on top of a lower backing plate 55. Also visible in FIG. 4 is a portion of flexible conductor protion 5 of said flexible circuit, on the lower surface of which (assuming said portion is folded as indicated in FIG. 4) are to be located various conductive paths 64, 65, etc., corresponding to the conductive paths making electrical connection between connector termination portions 12 and 36.

Figure 5:
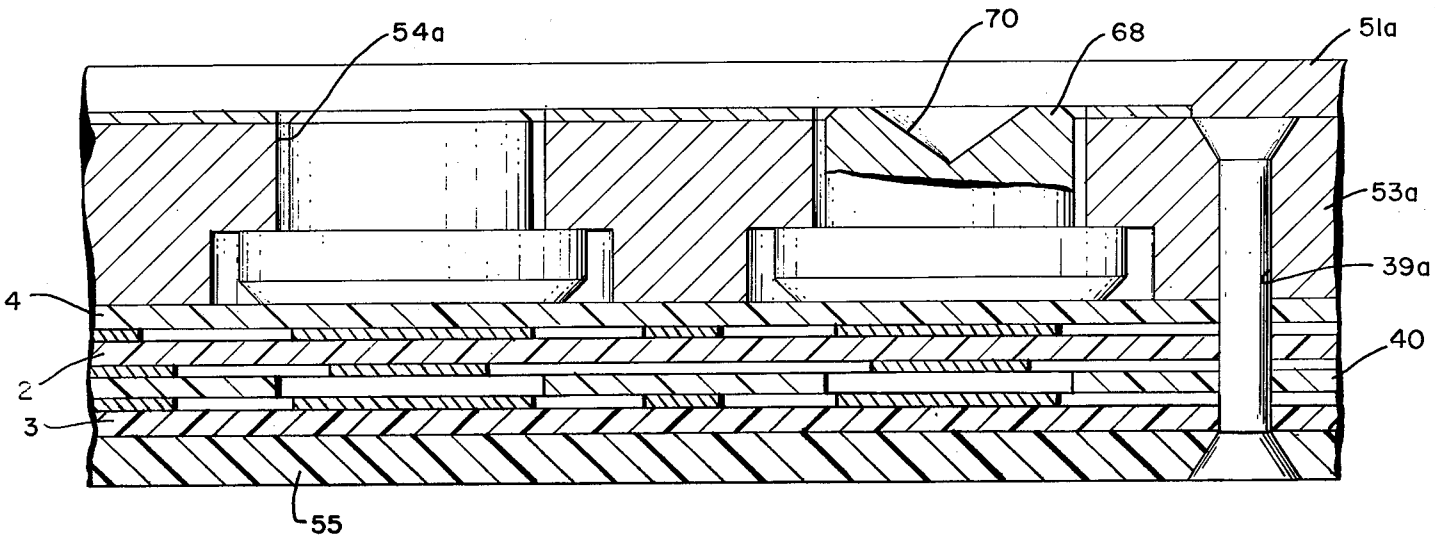
FIG. 5 is a variation of FIG. 3, whereby windows 54 have intermediate flush set buttons for indirect tool actuation.

FIG. 5 is a variation of the side elevation of the electronic wristwatch/calculator case of FIG. 3, showing windows 54 as having intermediate flush set buttons for indirect tool actuation.

Although the invention has been described above with particularity with respect to only one preferred embodiment thereof, it should be noted that numerous minor changes in design and construction in addition to those indicated will be obvious to one skilled in the art. Accordingly, the scope of the present invention should be no wise constrained by the exact details disclosed but rather should be interpreted in accordance with the appended claims.

What is claimed is:

1. As simplified tabulator keyboard assembly for use in a digital watch/calculator comprising:

a flexible circuit of unitary construction with metallic conductive areas and a flexible insulative backing, said flexible circuit comprising:

a lower array of contacts, each of said contacts make electrical connection to a contact terminator provided as part of said flexible circuit;

an upper array of deformable contacts, each of said deformable contacts making electrical connection to a contact terminator provided as part of said flexible circuit and being provided with a plurality of conductive tabs, one for each of said contacts in said lower array;

a flexible conductor portion for making electrical connection to at least the electronics module of said watch calculator;

said lower array and said upper array are separated by an insulative spacer having a plurality of holes, one for the intersection of each contact in said lower array with each contact of said upper array;

said upper array is folded over said lower array such that the metallic conductive portions thereof directly face the respective metallic conductive portions of said lower array but are separated thereform by said insulative spacer; and an indicia array having a plurality of numeric and other symbols defined by a metallized region, one of such symbols being provided for each of said holes in said insulative spacer; and said indicia array is folded over said upper array such that the metallized portions of said indicia array are in contact with the insulative backing of said upper array.

2. The tabulator keyboard of claim 1, wherein each of said contacts in said upper deformable contact array is additionally provided with a plurality of bridge reinforcing members.

3. The tabulator keyboard array of claim 1, wherein both said upper array and said lower array portions are provided with metallic reinforcing areas electrically insulated from said contacts.

4. The tabulator keyboard of claim 1, wherein the insulative areas separating the contacts in said upper array from their respective surrounding reinforcing metallization are greater in width than the corresponding insulating areas separating the contacts in said lower array from their corresponding reinforcing metallization.

* * * * *